United States Patent [19]

Stubblefield

[11] 4,454,662

[45] Jun. 19, 1984

[54] ATHLETIC SHOE SOLE

[76] Inventor: Jerry D. Stubblefield, 11725 NW. Damascus, Portland, Oreg. 97229

[21] Appl. No.: 347,419

[22] Filed: Feb. 10, 1982

[51] Int. Cl.[3] ..... A43B 7/14; A43B 5/00

[52] U.S. Cl. ..... 36/91; 36/102; 36/134; 36/59 R; 36/59 C

[58] Field of Search ..... 36/88, 91, 93, 102, 36/126, 128, 129, 67 R, 67 A, 67 B, 67 C, 67 D, 134, 130, 59 R, 59 C

[56] References Cited

U.S. PATENT DOCUMENTS

| | | | |
|---|---|---|---|
| 2,258,734 | 10/1941 | Brady | 36/67 D |
| 2,403,442 | 7/1946 | Klaus . | |
| 3,091,042 | 5/1963 | Gilkerson | 36/93 |
| 3,327,411 | 6/1967 | Roberts | 36/134 |
| 3,444,630 | 5/1969 | Morelli | 36/134 |
| 3,552,039 | 1/1971 | Fukuoka . | |
| 3,875,689 | 4/1975 | Tomas . | |
| 4,224,750 | 9/1980 | Delport . | |
| 4,235,028 | 11/1980 | Riggs . | |
| 4,262,435 | 4/1981 | Block et al. | 36/129 |
| 4,288,929 | 9/1981 | Norton et al. | |
| 4,309,832 | 1/1982 | Hunt | 36/31 |
| 4,314,412 | 2/1982 | Anderson et al. | 36/11.5 |

FOREIGN PATENT DOCUMENTS

| | | | |
|---|---|---|---|
| 2450514 | 4/1976 | Fed. Rep. of Germany | 36/11.5 |
| 2489104 | 3/1982 | France | 36/91 |
| 1196996 | 7/1970 | United Kingdom | 36/11.5 |

*Primary Examiner*—Werner H. Schroeder
*Assistant Examiner*—Steven N. Meyers
*Attorney, Agent, or Firm*—Saidman, Sterne & Kessler

[57] ABSTRACT

A sole for an athletic shoe, such as a cleated soccer or football shoe, comprises a thin, unitary member formed of flexible material. The member has a contour or configuration which renders the flexible material substantially rigid at the arch and heel portions of the sole. This provides substantial support to the arch of the foot. Cleats may extend from the toe and heel portions of the lower surface of the sole member.

20 Claims, 6 Drawing Figures

ATHLETIC SHOE SOLE

BACKGROUND OF THE INVENTION

1. Field of the Invention

This invention relates to improved outsoles for shoes, especially athletic shoes, and shoes embodying such outsoles.

2. Discussion of Related Art

Athletic shoes typically comprise a soft fabric or leather upper, an outsole including a treaded or cleated lower surface, an inner sole upon which the foot rests, and a midsole positioned between the outsole and the inner sole.

The midsole of a conventional athletic shoe is generally formed from a flexible, resilient, relatively soft material, to permit the shoe to absorb shock that results from impact of the foot with the ground. A typical outsole is made of a higher density, tougher, more rigid material to provide basic support for the shoe and foot as well as greater wear and tear. Despite its greater rigidity, the outsole also must be generally somewhat flexible. This form of flexible construction is necessary to facilitate ease of movement of the foot during certain athletic motions. A problem often arises, however, in that such a resilient, flexible structure may fail to give adequate support to the foot during certain types of activities.

This problem is especially prevalent in cleated shoes used in football and soccer which typically comprise a substantially flat outsole having cleats attached to or molded into the heel and toe portions thereof. The width of the outsole is narrowest at the arch, and typically flares out both forwardly and rearwardly to the ball of the foot and the heel, respectively. When the weight of the wearer is brought to bear on the toe and heel portions of such a shoe (where the cleats are normally located), the mid-portion of the outsole, having no cleats thereat and being relatively narrow and thus weak, tends to provide very poor support for the arch of the foot, causing discomfort and, in some cases, substantial strain. Further, this weakness of the arch portion of presently available cleated shoes undesirably causes the arch portion to flex under use, thereby further weakening the shoe where it least needs weakening.

Orthotic inserts have become popular, especially among serious runners, in order to provide a better fit with the substantially flat insoles of their shoes. Such an insert comprises a custom molded, generally soft body, whose upper surface conforms precisely to the contour of the bottom of a foot of the individual wearer. Such inserts may also improve stability. One orthotic insert used in an athletic shoe is set forth in U.S. Pat. No. 4,235,028 to Riggs.

While orthotic inserts perform a useful function, they are not without their drawbacks. Being made of a soft resilient material, their ability to combat sagging arches is limited. They may shift out of position during use, causing discomfort and impeding motion of the foot. They also add additional weight to each foot, a distinct disadvantage in many athletic activities. Furthermore, the orthotic insert, being custom made, must be purchased at substantial cost, adding additional expense to the cost of the footwear.

Various shoe structures have been devised for the purpose of providing adequate support for the foot. For example, U.S. Pat. No. 2,403,442 to Klaus discloses a sport shoe including an arch support molded within the insole thereof. While this shoe may provide adequate arch support, the structure of the shoe includes an outsole, an insole, and an arch support molded within the insole. These components must be assembled to each other during manufacture of the shoe, adding to the cost of the end product.

It is also well known to provide foot support by means of a molded sole or insole having an upper surface contoured to conform to the shape of the bottom: of the foot. Such soles and insoles are typically bulky, inflexible and comprise a lower surface which is itself treaded or adapted to be secured to a treaded outsole. For example, molded soles are disclosed in U.S. Pat. No. 3,552,039 to Fukuoka and U.S. Pat. No. 3,875,689 to Frau Tomas. These soles are relatively thick and heavy, having a slab-like, inflexible configuration. While each apparently provides support for the foot, due to their relatively heavy and inflexible structures, neither is suitable for active use, such as in athletics.

U.S. Pat. No. 4,224,750 to Delport discloses a metatarsal arch support having an upper surface with a special, molded shape and a flat lower surface adapted to be secured to an outsole of a sports shoe. The outsole may include cleats of various types. This shoe allegedly provides better support for the foot by positioning cleats or spikes in critical positions on the outsole. However, the arch support is relatively thick and therefore adds undesirable weight to the sports shoe.

U.S. Pat. No. 4,288,929 to Norton et al. discloses a polyurethane control device for an athletic shoe positioned between the upper and sole in the heel region. The device includes a flat base and side walls extending around the heel on the periphery of the base, and is designed to control pronation.

SUMMARY OF THE INVENTION

The present invention, in its preferred aspect, comprises a substantially thin, unitary member made of a flexible material and including heel, toe and arch portions, and means for enhancing the rigidity of the member in the arch position. In a preferred embodiment, the means comprises the shape of the member, which includes a cup-like portion curved at the arch portion in a direction transverse to the longitudinal axis of the member. The curve preferably conforms substantially to the shape of the arch of a foot of a wearer of the shoe. Additionally, the heel portion of the member preferably conforms substantially to the shape of the heel of a wearer of the shoe.

In accordance with other aspects of the present invention, a plurality of cleats extend downwardly from the unitary member at the heel and toe portions thereof, whereby upon ground contact the arch portion will be supported in an elevated position by the cleats.

In accordance with yet another aspect of the present invention, the shoe sole includes means formed in the unitary member for increasing transverse flexibility in the toe portion. Further, the member is preferably formed of material having a high modulus of elasticity, whereby the member is not readily stretchable or compressible.

In accordance with another aspect of the present invention, there is provided a sole for a shoe, which comprises a substantially thin, unitary member made of a flexible material and having an inner surface conforming substantially to the shape of the bottom portion of a foot and an outer surface conforming substantially to the shape of the inner surface. The member has toe, heel and arch portions and is relatively longitudinally and laterally rigid in the region of the arch portion and relatively laterally flexible in the region of the toe portion. Further, the member is relatively rigid in the region of the heel portion. The member is preferably curved in a direction transverse to the longitudinal axis of the sole at least in the region of the arch portion thereof.

In accordance with yet another aspect of the present invention, a shoe sole is provided which comprises a substantially thin, unitary outsole made of a flexible material and having upper and lower surfaces, and toe, heel and arch portions which are integrally formed and include peripheral portions. The upper surface is adapted to be fastened to a shoe upper and is contoured to receive the foot of a wearer. The lower surface is contoured similarly to the upper surface and includes a plurality of cleat members extending from the toe and heel portions thereof. The peripheral portions of the outsole include a cup-like shape for providing substantial rigidity to the arch portion of the outsole.

In accordance with yet another aspect of the present invention, a shoe is provided which comprises an upper, a sole attached to the upper, the sole consisting essentially of a thin, unitary member having inner and outer surfaces conforming substantially to the shape of the bottom portion of a foot. At least a portion of the thin, unitary member has a configuration which imparts rigidity thereto in the region of the arch.

BRIEF DESCRIPTION OF THE DRAWINGS

The present invention may be more readily appreciated and understood when considered in conjunction with the accompanying drawings, in which.

DETAILED DESCRIPTION OF THE PREFERRED EMBODIMENT

Figure 1:
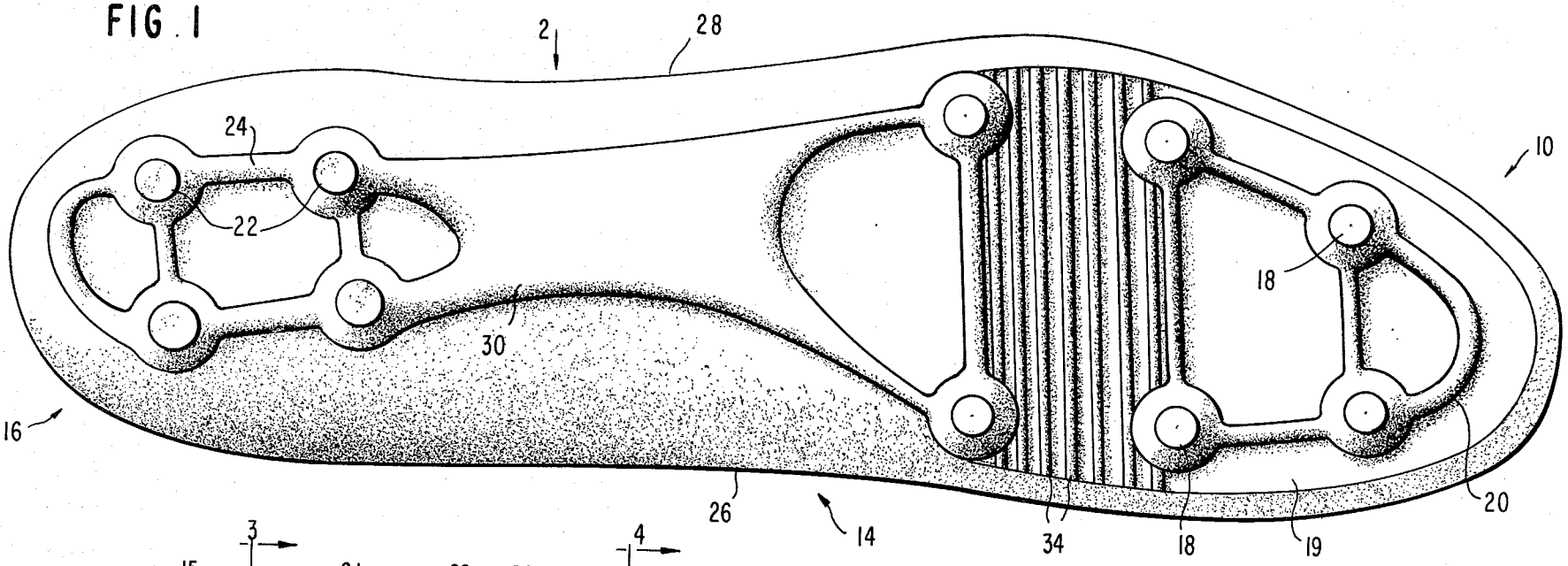
FIG. 1 is a bottom view of a preferred embodiment of a shoe sole in accordance with the present invention.
Figure 2:
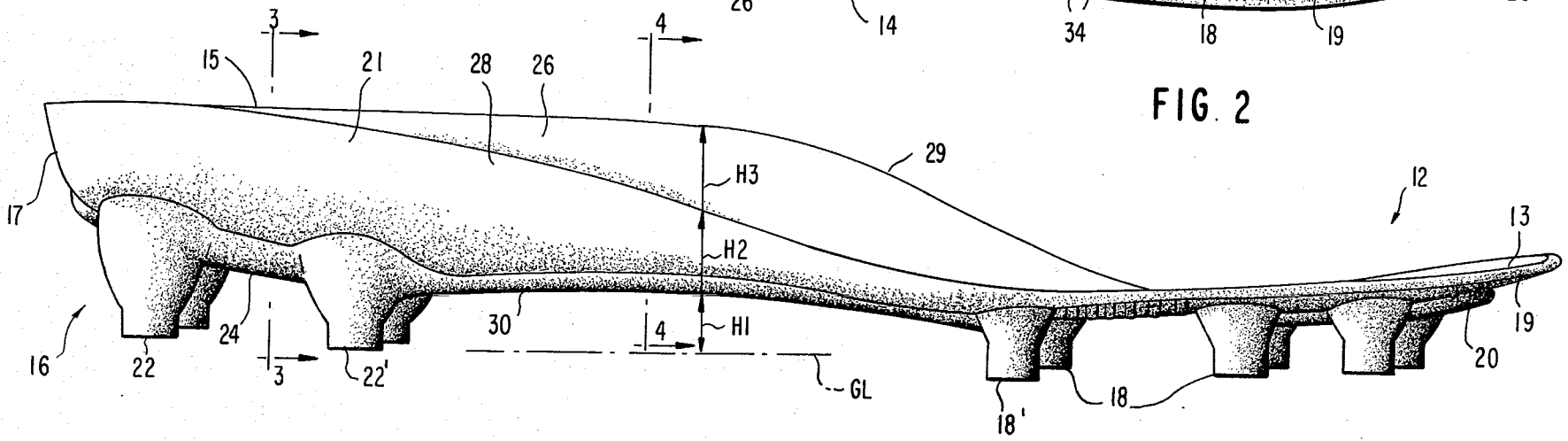
FIG. 2 is a side view of the sole of FIG. 1 taken in the direction of arrow 2.

FIGS. 1 and 2 illustrate one preferred embodiment of a shoe sole in accordance with the present invention, designated generally by reference numeral 10. Sole 10 preferably comprises a unitary piece of molded material, such as polyurethane, nylon or PVC, having a substantially uniform thickness of about 1/16 inch between its upper surface 13 and its lower surface 19. The preferred range of thickness is between 1/32 inch and ⅛ inch. When lying in a substantially flat sheet, polyurethane of this thickness is very flexible and easily bent. As will become more clear hereinafter, however, the unique contour of the sole of the present invention results in a relatively sturdy, rigid structure which is nevertheless sufficiently flexible and yieldable for the uses intended.

Sole 10 includes generally a toe portion 12, an arch portion 14 and a heel portion 16. Toe portion 12, while having a slight contour to match that of the bottom of a foot, is generally flat and includes a plurality of cleats 18 extending from lower surface 19. As is conventional, a plurality of ridges 20 may extend between adjacent cleats 18, providing a certain degree of rigidity for this portion of sole 10 as well as reinforcement for cleats 18. Ridges 20 are preferably integrally molded with sole 10, while cleats 18 may be integrally molded or detachable.

Figure 3:
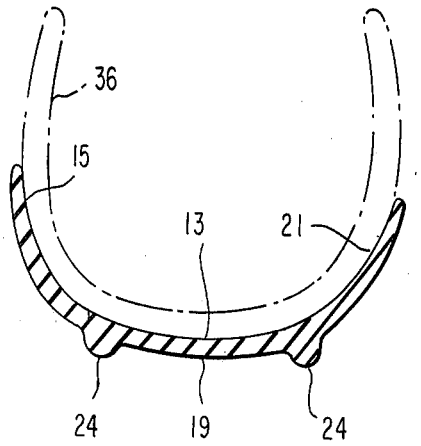
FIGS. 3 and 4 are sectional views of the sole taken along lines 3—3 and 4—4 of FIG. 2, respectively.

Heel portion 16 is generally cup-shaped, conforming closely to the shape of the heel of a foot. As seen in FIG. 3, heel portion 16 is curved from side-to-side, as well as at the rearmost portion thereof (FIG. 2). The cup-shaped heel portion 16 more particularly includes inner side wall 15 and outer side wall 21 connected by rear wall 17. It may be appreciated that inner side wall 15 is somewhat higher than the laterally corresponding portion of outer side wall 21. This differential height gradually increases towards the arch and toe portions of the sole, as will be explained more fully below, to provide the desired rigidity and support especially for the inner arch. Heel portion 16 also has extending from the lower surface 19 thereof a plurality of cleats 22 as well as a plurality of ridges 24. It should be understood that the particular number and configuration of cleats 18 and 22 are illustrative only, as many different combinations of same are possible.

Heel portion 16 fully supports the heel longitudinally, vertically and laterally. The curved or cup-like configuration of sole 10 in the region of heel portion 16 imparts substantial rigidity to the otherwise very flexible material.

Figure 4:
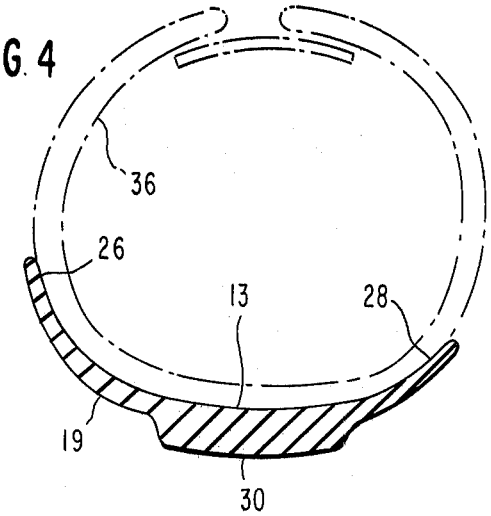

Arch portion 14 includes an up-turned inner side wall 26, and an opposite, outer side wall 28 which is curved upwardly to a lesser extent, as best seen in FIG. 4. Outer side wall 28 extends continuously from outer side wall 21 of heel portion 16, while inner side wall 26 extends continuously from inner side wall 15 of heel portion 16. As may be seen in FIG. 1, the substantial width of the sole at arch portion 14 helps to eliminate the inherent weakness of narrow prior art arch designs. The curved cup-like configuration of sole 10 in the region of arch portion 14, cooperating together with the width of the arch portion and curved configuration in the heel portion 16, imparts substantial longitudinal rigidity to arch portion 16 of sole 10, as well as good lateral rigidity.

It is important that sole 10 be molded of a material having a high modulus of elasticity. Such material, while flexible when laid flat, is not readily stretchable or compressible. Therefore, when formed into a curved, cup-like or box-like configuration, as seen in FIGS. 3 and 4, the material forms a sturdy, substantially rigid structure.

As may be appreciated from FIGS. 2 and 4, the height differential between the inner and outer side walls reaches a maximum in the arch portion 14 just before the inner side wall 26 beings tapering downwardly as at 29 to follow the contour of the inner arch. The outer wall 28 is lower and tapers downwardly more quickly so as not to interfere with bone structure on the outer side edge of the foot.

When sole 10 rests on the ground, and the weight of the wearer is brought to bear on the upper surface 13 thereof, the arch of the foot will be well supported due to the substantial rigidity at arch portion 14 resulting from the curved, cup-like or box-like configuration of the sole. That is, arch portion 14 does not have a tendency to droop or sag (as with cleated shoes of the prior art), regardless of the fact that no cleats are positioned at the arch portion.

An increased thickness, reinforcing portion 30 may be integrally molded on outer surface 19 of sole 10 in the region of arch portion 14 if it is desirable to further enhance the rigidity of sole 10 in this region. It should be understood that reinforcing portion 30 is optional, since the curved, cup-like configuration of arch portion 14 imparts sufficient rigidity to sole 10 to adequately support the arch in the manner described.

By way of example, and without any intent of limiting the invention, the height H1 (see FIG. 2) of the bottom surface of the arch portion 14 above the ground level GL is approximately 0.625 inch measured without any foot loading and at the approximate midpoint between cleats 18' and 22'. The height H2 of outer side wall 28 above ground level GL is approximately 1.25 inches, while the height of inner side wall 26 above ground level GL is approximately 1.875 inches. Finally, the width across arch portion 14 from the edge of one side wall to the other is on the order of 3.0 inches. Again, such measurements are only approximations and exemplary of one construction and size which provides the desired arch rigidity and should not be taken to be limiting in any manner.

Rigid arch and heel portions 14 and 16 provide vertical and lateral support for the foot while relatively flat toe portion 12 is highly flexible. The outer surface 19 of toe portion 12 may include laterally extending, reduced thickness grooves 34 in the region of the ball of the foot, providing the greatest flexibility for the sole in that region.

Figure 5:
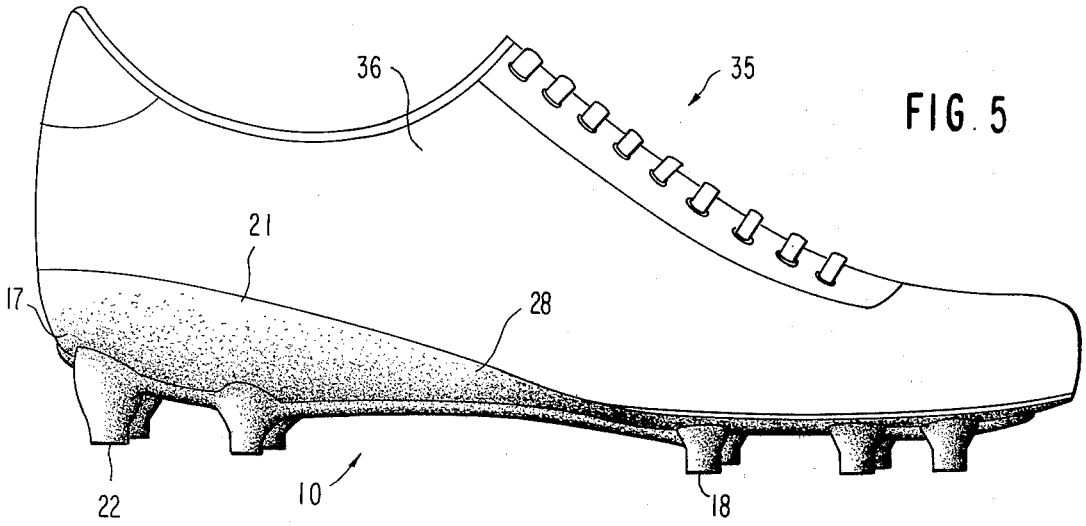
FIGS. 5 and 6 are opposite side views of a shoe in accordance with the present invention, embodying the sole of FIGS. 1-4.
Figure 6:
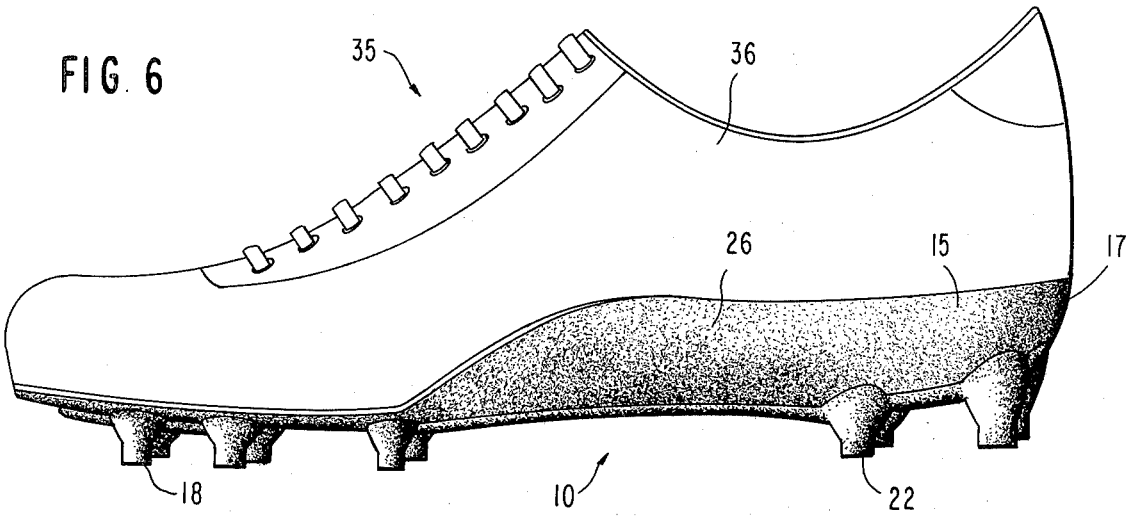

FIGS. 5 and 6 illustrates a shoe 35 in accordance with the present invention. Shoe 35 comprises an upper 36 which is formed on a last which has a contour on the lowest part thereof matching upper surface 13 of sole 10. Upper 36 is attached to upper surface 13 of sole 10 and is received within the curved and cup-shaped arch and heel portions 14 and 16 thereof. Conventional techniques may be employed to fasten the sole and upper to one another.

One feature of the present invention is that the shoe illustrated in FIG. 5 essentially comprises only an upper and a unitary sole member as described with respect to FIGS. 1–4. Because sole 10 conforms closely to the shape of the foot, no midsole is required to interface comfortably with the foot. The only element interposed between the foot and molded sole 10 is the thin lowermost portion of upper 36, which is glued or otherwise fastened to upper surface 13 of sole 10 during assembly of shoe 35. However, a sponge sock liner or the like may be placed within upper 36 in final assembly.

It is apparent that a sole in accordance with the present invention is remarkably simple in structure yet functionally superior to support soles and athletic shoes of the prior art. While typical molded soles comprise relatively thick, inflexible configurations having an upper surface conforming to the shape of the foot and a lower surface of a substantially different configuration, the present invention comprises a thin, molded structure having an upper surface conforming to the shape of the foot and a lower surface of substantially the same configuration as the upper surface. The sole is thus very lightweight, a desirable feature, particularly in athletic shoes.

Despite the fact that the material forming the sole of the invention is very thin and flexible, the unique cup- or box-like configuration of the inventive sole renders selected portions thereof sufficiently rigid and sturdy to support the foot longitudinally, vertically and laterally. Indeed, the one-piece sole of the present invention provides much better support than the support typically afforded by orthotic inserts commonly employed with athletic shoes of the prior art. The invention therefore eliminates the need for such inserts, simultaneously reduces the weight of the shoe itself, and affords greater rigidity and protection for the arch of the foot.

The one-piece sole of the present invention is very simple to manufacture and may be easily produced at a relatively low cost. The simplicity and integrity of the one-piece sole makes it substantially more durable than many soles of the prior art.

Shoe 35 of the invention possesses all of these advantages associated with the sole. Additionally, the simplicity of the shoe structure reduces complexity and cost of assembly thereof. Once upper 36 is manufactured, only one fastening step is required to completely assemble the shoe by affixing the upper to the one-piece sole.

Sole 10 having the configuration illustrated in the drawings, including cleats 18 and 22, is suitable for use in games such as soccer and football. It should be understood, however, that a sole and shoe in accordance with the invention may be formed with different cleats or other lower surface configurations suitable for other athletic activities or for general use. As these and other modifications may be made by those skilled in the art, it should be understood that the invention is not limited to the configuration illustrated in the drawings, the invention being limited only by the claims appended hereto.

I claim as my invention:

1. A sole for a shoe, comprising:

a unitary member made of a flexible material;

said member having toe, heel and arch portions, an upper surface, a lower surface, and a substantially thin wall, the portions of said upper surface and said lower surface which form said wall having a substantially similar shape;

said wall extending substantially continuously about said heel and arch portions to form a cup shape at said heel and arch, whereby said member is relatively rigid in the region of said arch portion.

2. A sole as set forth in claim 1, wherein said wall comprises the peripheral portion of said upper and lower surfaces in said heel and arch portions.

3. A sole as set forth in claim 1, wherein said upper surface substantially conforms to the shape of the bottom portion of a foot.

4. A sole as set forth in claim 1, further comprising a plurality of cleats extending downwardly from said lower surface of said heel and toe portions.

5. A sole as set forth in claim 4, wherein said cleats are formed integrally with said member.

6. A sole as set forth in claim 4, further comprising a plurality of ridges formed integrally with said member extending between said cleats.

7. A sole as set forth in claim 1, wherein said toe portion is relatively flat, whereby said member is highly flexible in the region of said toe portion.

8. A sole as set forth in claim 7, further comprising means formed in said member for increasing flexibility in said toe portion.

9. A sole as set forth in claim 8, wherein said means is formed in said lower surface of said toe portion, and comprises laterally extending grooves in the region of the ball of the foot.

10. A sole as set forth in claim 1, wherein said wall at said heel portion further comprises:

an inner heel side wall;

an outer heel side wall; and a rear wall connecting said inner and outer side walls;

said inner heel side wall being somewhat higher than the laterally corresponding portion of said outer heel side wall.

11. A sole as set forth in claim 10, wherein the difference in height between said inner and outer heel side walls gradually increases towards said arch and toe portions.

12. A sole as set forth in claim 10, wherein said wall at said arch portion further comprises:

an inner arch side wall extending continuously from said inner heel side wall of said heel portion; and an outer arch side wall extending continuously from said outer heel side wall of said heel portion, opposite said inner arch side wall;

said outer arch side wall being curved upwardly less than said inner arch side wall.

13. A sole as set forth in claim 12, wherein said inner and outer arch side walls taper downwardly towards said toe portion, and the difference in height between said inner arch side wall and said outer arch side wall reaches a maximum just before said inner arch side wall beings to taper.

14. A sole as set forth in claim 12, wherein said inner arch side wall is higher than the laterally corresponding portion of said outer arch side wall.

15. A sole as set forth in claim 1, wherein said member has a substantially uniform thickness between said upper and lower surfaces.

16. A sole as set forth in claim 15, wherein the thickness of said member is between approximately 1/32 inch and approximately ⅛ inch.

17. A sole as set forth in claim 16, wherein the thickness of said member is approximately 1/16 inch.

18. A sole as set forth in claim 1, further comprising reinforcing means formed integrally on said lower surface of said member in the region of said arch portion.

19. A sole as set forth in claim 1, wherein said member is formed of material having a high modulus of elasticity, whereby said member is not readily stretchable or compressible.

20. A cleated shoe, which comprises:

an upper;

an outer sole attached to said upper, said outer sole comprising:

a unitary member made of a flexible material;

said member having toe, heel and arch portions, an upper surface and a lower surface, a substantially thin wall, the portions of said upper surface and said lower surface which form said wall having a substantially similar shape;

said wall extending substantially continuously about said heel and arch portions to form a cup shape at said heel and arch, whereby said member is relatively rigid in the region of said arch portion; and a plurality of cleats extending downwardly from said lower surface of said heel and toe portions.

* * * * *